United States Patent [19]

Tucker et al.

[11] 3,982,781

[45] Sept. 28, 1976

[54] GOLF BALL RETRIEVER

[75] Inventors: Walter J. Tucker, Marion, Ind.; Melvin R. Edwards; Richard J. Tucker, both of Eden, N.C.

[73] Assignees: Walter J. Tucker, Marion, Ind.; Melvin R. Edwards; Richard J. Tucker, both of Eden, N.C.

[22] Filed: Dec. 9, 1974

[21] Appl. No.: 530,869

[52] U.S. Cl. ..... 294/19 A

[51] Int. Cl.[2] ..... A63B 57/00

[58] Field of Search ..... 294/19 R, 19 A, 99 R; 56/328 R

[56] References Cited

UNITED STATES PATENTS

| | | | |
|---|---|---|---|
| 704,848 | 7/1902 | Minton | 294/19 A |
| 2,203,170 | 6/1940 | MacDonald | 294/19 A |
| 2,810,252 | 10/1957 | Kelly | 294/19 A X |
| 2,972,851 | 2/1961 | Goehring | 294/19 A X |
| 3,026,666 | 3/1962 | Baugh | 294/19 A X |
| 3,117,814 | 1/1964 | Webb | 294/19 A |
| 3,258,286 | 6/1966 | Coward | 294/19 A |
| 3,316,008 | 4/1967 | Baugh | 294/19 A |

*Primary Examiner*—Johnny D. Cherry

[57] ABSTRACT

A manually operable portable golf ball retriever having an open ended enclosure with spring means for permitting the entry of one or more golf balls to be gathered and a releasable closure opening to remove retrieved golf balls.

1 Claim, 5 Drawing Figures

GOLF BALL RETRIEVER

BACKGROUND OF THE INVENTION

Golfers in practice sessions for driving and putting use a number of golf balls and they are usually gathered by bending and stooping each time another golf ball is found and picked up. A number of different types of golf ball retrieving appliances have been marketed and patented including one the type shown in U.S. Pat. No. 3,258,286 in which a number of golf balls may be collected and stored in a chamber for subsequent removal without repetitive stooping and bending. There are other devices for achieving the same result as shown in U.S. Pat No. 3,186,593, among others.

The present invention is for a manually operable portable golf ball retriever that is very light in weight and may be carried readily in the golfer's bag with imperceptible weight increase. The portable golf ball retriever of this invention is durable, inexpensive, and has no parts that are complex to operate or which are difficult to repair or replace readily.

An advantage of the present golf ball retriever is that it may be provided with a flexible enclosure that is washable and may be waterproof, if desirable.

Other objectives and many of the advantages of this novel golf ball retriever will become more readily apparent from a detailed description of one preferred embodiment.

DESCRIPTION OF THE DRAWING

One preferred embodiment of the invention is shown in the accompanying drawing in which.

DETAILED DESCRIPTION OF THE INVENTION

Figure 1:
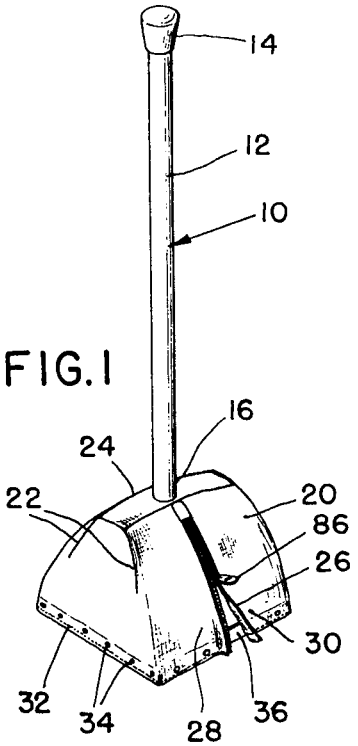
FIG. 1 is a perspective view of the portable golf ball retriever illustrating the closure member in a partially open condition.
Figure 2:
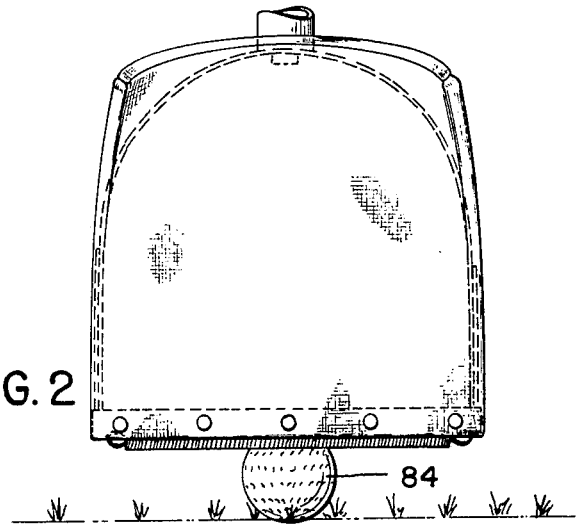
FIG. 2 is a partial, enlarged, transverse sectional view of the golf ball retriever positioned over a golf ball preparatory for capturing it and inserting it into the enclosure.
Figure 5:
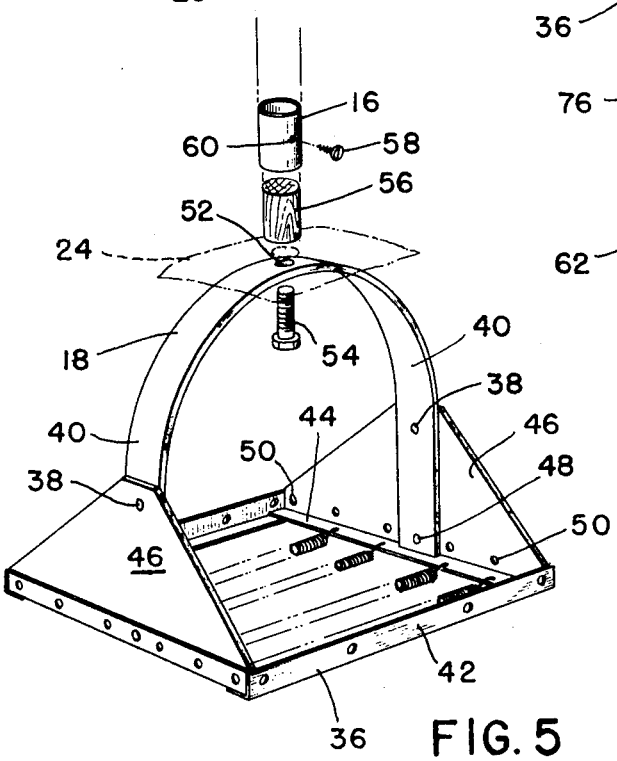
FIG. 5 is a partial exploded view of the yoke and resilient members supporting frame with the resilient members secured thereto in spaced relation with only a portion of the enclosure covering shown in outline form.

Referring to the drawing and particularly to FIG. 1, there is shown a manually operable, portable golf ball retriever 10 which is provided with a vertically extending handle 12 which may preferably be made of aluminum tubing of a desired length, and that one end thereof is a cap 14 mounted which may be of plastic or other suitable material to protect the hand of the golfer. The other end 16 of the member 12 is connected to an inverted U-shaped yoke 18, as shown in FIG. 5, over which is draped, in tent-like fashion, a flexible and pliable covering 20 which may be made of waterproofed fabric, vinyl, nylon or any other suitable and durable fabric material suitably sewn along the seams 22 at the sides and at the top 24 providing an opening for the end of the handle 16 to pass through to connect to the inverted U-shaped yoke 18. A heavy duty zipper 26 is suitably sewn into the closure member 20 so that the individual flaps 28 and 30 may be opened when the zipper is slid into the upper position enabling one to gain access to the interior of the closure. The bottom skirt 32 of the closure 20 is secured by suitable rivets 34 or other fastening means to the metal frame 36 that is supported by rivets 38 on each of the depending legs 40 on the inverted U-shaped yoke. The base frame 36 may be made of a right-angle extrusion or bent aluminum to form a vertical perimetrical wall 42 and a perimetrical base 44.

Side triangularly-shaped stiffening members 46 are connected to the legs 40 by the rivets 38 and 48 with separate rivets 50 connecting the base of the triangular stiffening members 46 to the perimetrical vertical wall 42.

The inverted U-shaped yoke 18 is suitably drilled to form a bolt opening 52 through which the bolt 54 will pass to be threadably connected to the short stub 56 which is telescopically received within the lower end 16 of the handle 12. A suitable set screw 58 is positioned through the set screw opening 60 to secure the handle to the member 56. Obviously other fastening means may be utilized to achieve the same result including a bayonet connection or a spot welded connection may be formed, if desirable.

The frame 36 is illustrated in a square or substantially square configuration with each of the corners of the angle members 36 being securely fastened by rivets 62. The opening 64 in the frame 36 is provided with a series of spaced-apart resilient members 66, 68, 70, and 72.

Each of the resilient members 66–72 is shown as a tension helical coil spring provided with hook-like ends 74 for cooperative insertion into the spaced-apart openings 76 provided in the bottom perimetrical flange 44. It will be readily apparent that in place of the helical coil springs, elastic bands or other resilient members may be utilized which will spread apart sufficiently to enable a golf ball to be introduced into the chamber 10 with a minimum of downward force being applied while still retaining a ball captured within the chamber 20.

Figure 3:
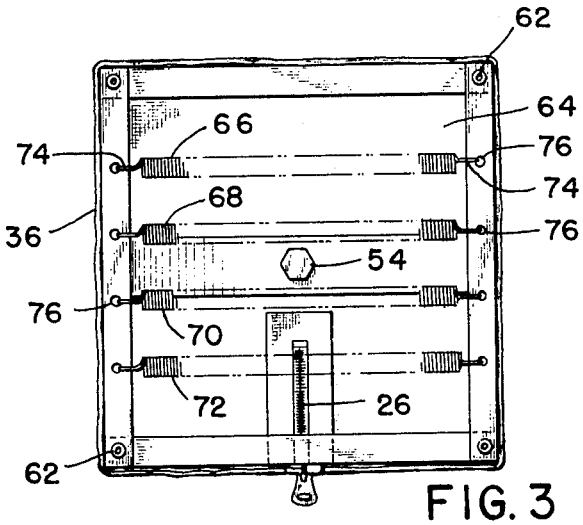
FIG. 3 is a bottom plan view illustrating the various resilient members in spaced relation, some in outline form only, and the releasable closure member.
Figure 4:
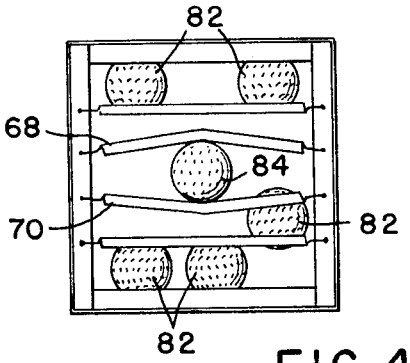
FIG. 4 is another plan view in schematic form illustrating a number of golf balls captured and retained within the enclosure with one ball about to be inserted by spreading apart a pair of adjacent resilient spring members.

As shown in FIG. 4, a number of golf balls 82 have been captured and are being retained within the chamber 20 while another golf ball 84 is about to be introduced into the chamber 20 as the adjacent resilient members 68 and 70 have been spread apart slightly. With further downward force applied to the handle, the golf ball 84 will enter the chamber and the resilient members 68 and 70 will return to their original unstressed condition shown in FIG. 3.

It has been found that several golf balls may be captured simultaneously provided they are positioned sufficiently within the perimeter of the frame 42 with but a single downward stroke of the handle.

After the balls have been collected, they may be removed readily from the chamber 20 by elevating the zipper tong 86 permitting one to remove as many of the golf balls as desirable while retaining others.

We claim:

1. A manually operable, portable, golf ball retriever comprising a handle, said handle being of such length to permit the user to remain in an upright position while retrieving golf balls, an inverted u-shaped yoke mounted at one end of said handle, said yoke having vertically depending spaced-apart legs, an open frame having a pair of upwardly converging members mounted opposite each other and secured to said yoke, a plurality of spaced-apart springs extending transversely across the open frame, said springs being spaced-apart from each other a distance less than the diameter of a golf ball, a flexible cover member, said cover being a water impervious fabric having a releasable means for opening and closing said cover member, secured to said frame enveloping said yoke and said converging members to form a ball-receiving tent closure for retaining a plurality of retreived golf balls urged into said enclosure between said springs.

* * * * *